US006948214B2

(12) United States Patent
Spalding et al.

(10) Patent No.: US 6,948,214 B2
(45) Date of Patent: Sep. 27, 2005

(54) REMOVABLE DOOR CHECK DEVICE

(75) Inventors: Craig Spalding, Sterling Heights, MI (US); Aaron O'Brien, Jackson, MI (US); Marc Milam, Rochester Hills, MI (US)

(73) Assignee: Edscha North America, Pontiac, MI (US)

( * ) Notice: Subject to any disclaimer, the term of this patent is extended or adjusted under 35 U.S.C. 154(b) by 0 days.

(21) Appl. No.: 10/358,459

(22) Filed: Feb. 5, 2003

(65) Prior Publication Data

US 2004/0148735 A1 Aug. 5, 2004

(51) Int. Cl.[7] ..... E05F 5/02
(52) U.S. Cl. ..... 16/82; 16/83; 16/DIG. 17
(58) Field of Search ..... 16/83, 84, DIG. 17, 16/82, 85, 86 R, 86 A, 86 B, 86 C, 374

(56) References Cited

U.S. PATENT DOCUMENTS 3,729,772 A * 5/1973 Marchione ..... 16/334
4,858,273 A * 8/1989 Civitelli ..... 16/86 A
5,450,652 A * 9/1995 Webb ..... 16/82
5,577,295 A 11/1996 Papke et al. ..... 16/254
5,675,865 A * 10/1997 van der Steur ..... 16/82
5,692,264 A * 12/1997 van der Steur ..... 16/82
5,711,557 A * 1/1998 Nicolosi ..... 292/288
5,924,170 A * 7/1999 Papke et al. ..... 16/321
6,003,911 A * 12/1999 Sowash ..... 292/343
6,016,588 A * 1/2000 Kamerschen ..... 16/82
6,108,866 A 8/2000 Waynick, Jr. ..... 16/82
6,332,243 B1 * 12/2001 Kim ..... 16/334
6,334,236 B1 1/2002 Kalliomaki ..... 16/334
6,430,835 B1 8/2002 Ranucci et al. ..... 33/645

* cited by examiner

*Primary Examiner*—John B. Walsh
(74) *Attorney, Agent, or Firm*—Davidson, Davidson & Kappel, LLC

(57) ABSTRACT

A removable door check device for use for use with a door hinge for holding a vehicle door in an opened position. The removable door check device includes a body, a first contact element extending from the body and having a first contacting surface, and a second contact element extending from the body and having a second contacting surface facing the first contacting surface. The first and second contacting surfaces are moveable with respect to each other to permit release of the door check device. In addition, a door hinge includes a first hinge part, a second hinge part pivotally connected to the first hinge part, and a removable door check device. The removable door check device includes a first contact element having a first contacting surface configured to engage the first hinge part and a second contact element having a second contacting surface facing the first contacting surface and configured to engage the second hinge part when the door hinge is in the opened position.

30 Claims, 5 Drawing Sheets

REMOVABLE DOOR CHECK DEVICE

BACKGROUND OF THE INVENTION

The present invention relates generally to a door check device, and more particularly to a removable door check device for use with a door hinge for holding a vehicle door in an opened position. The present invention also relates to a door hinge including a removable door check device.

During the manufacture of vehicles, the vehicle body and doors are typically painted together in a single process step after the doors have been mounted to the vehicle. It may be desirable to keep the vehicle doors held in an opened position temporarily so that the certain painting operations can be performed.

U.S. Pat. No. 6,334,236 describes a vehicle door prop clip for a vehicle hinge having split hinge pins. The prop clip is mounted onto the vehicle hinge by placing a sleeve member of the prop clip over one of the hinge pins in the split-pin hinge. The prop clip includes two lobes which compress as one hinge part is pivoted with respect to the other hinge part and contact the lobes. A disadvantage of the this device is that it is only useable on hinges having split pins, and wherein at least one of the split pins is accessible.

U.S. Pat. No. 6,332,243 describes a door check mechanism that includes first and second hinge parts rotatably connected on an axis of rotation. The mechanism includes a third, intermediate hinge part that is also rotatably connected on hinge pins about the axis of rotation and includes a cam surface. A flexible prop button is mounted to one of the first and second hinge parts and is adapted to releasably contact the cam surface of the intermediate hinge part as the door is rotated about the hinge so as to releasably hold the door in an opened position. A disadvantage to this solution is that it requires a permanent additional moving part (the intermediate hinge part) to be added to the hinge. Only the prop button is removable after the painting process, while the intermediate hinge part remains permanently as part of the hinge.

U.S. Pat. No. 6,108,866 describes a resilient detent mechanism for selectively maintaining a vehicle door in an opened position. The detent mechanism is mounted to the hinge by engagement with the hinge pin of the door. As the door is moved to a fully opened position, a corner of the mechanism interferes with a portion of the hinge and is compressed. Like the devices described above, this one requires access to the hinge pin to function.

U.S. Pat. No. 5,924,170 describes a removable detent mechanism for use with a vehicle door hinge for providing a removable door check mechanism. The detent mechanism is detachably secured to the hinge pin of the door.

BRIEF SUMMARY OF THE INVENTION

An object of the present invention is to provide a low cost and effective removable door check device that does not require contact with a hinge pin or hinge axis. An alternate or additional object of the invention is to provide a door check device that can function with hinges having standard or split hinge pins and in which the hinge pin or pins are inaccessible. An alternate or additional object of the invention is to provide a door check device that can function with existing hinge designs and/or can be used without requiring additional components for the hinge with which it is used.

The present invention provides a removable door check device for use with a door hinge for holding a vehicle door in an opened position. The device includes a body, a first contact element extending from the body and having a first contacting surface, and a second contact element extending from the body and having a second contacting surface facing the first contacting surface. The first and second contacting surfaces are moveable with respect to each other to permit release of the door check device.

At least one of the body, the first contact element and the second contact element is preferably flexible to permit the first and second contact surfaces to be moveable. The first and second contacting surfaces may be parallel to each other, but that is not required. The contacting surfaces can be considered facing each other, as long as a face portion of one surface points in a direction that is less than 90 degrees to the direction of a face portion of the other surface.

The first and second contact elements are preferably integrally formed from a single piece of material. One or both of the first and second face surfaces may include a convex surface.

The first contact element may include a cylindrical pin, which may include an outer flange. The pin may include an end portion having a diameter narrower than a diameter of the flange. This configuration allows easy installation of the pin into a hole in a hinge part of a vehicle hinge and provides firm engagement of the pin with that hinge part. The second contact element may include a first flexible arm having the second contacting surface and a second flexible arm having a third contacting surface wherein both the second and third surfaces are facing the first contacting surface. The first and second flexible arms may extend in a plane perpendicular to an axis defined by the cylindrical pin and may include end portions that are flexibly displaceable with respect to each other.

The present invention also provides a door hinge that includes a first hinge part, a second hinge part pivotally connected to the first hinge part and a removable door check device. The removable door check device includes a first contact element configured to engage the first hinge part and a second contact element configured to engage the second hinge part when door hinge is in the opened position. At least portions of the first and second hinge parts are disposed between the first and second contact elements when the door hinge is in the opened position.

The present invention further provides a door hinge that includes a first hinge part, a second hinge part pivotally connected to the first hinge part, and a removable door check device. The door check device includes a first contact element having a first contacting surface configured to engage the first hinge part and a second contact element having a second contacting surface facing the first contacting surface and configured to engage the second hinge part when the door hinge is in the opened position.

The door hinge with the door check may be configured so that an external closing force applied to one of the first and second hinge parts creates a tension between the first and second contact elements.

The first contacting surface may be configured to engage a rear edge portion of the first hinge part. The door check device may also include a clip element configured to engage a front edge portion of the first hinge part. The clip element preferably includes a bent end for engaging a distal side of the first hinge part adjacent the front edge portion. The second contacting surface is preferably configured to engage a front edge of the second hinge part.

The first contact element may alternatively include a cylindrical pin for engaging a hole in the first hinge part. The pin preferably has an outer flange for engaging a distal end of the hole. The second contact element may include a first flexible arm having the second contacting surface and a second flexible arm having a third contacting surface wherein both the second and third contacting surfaces face the first contacting surface. The first and second flexible arms may extend in a plane perpendicular to an axis defined by the pin. The first and second flexible arms preferably each include an end portion and the end portions are preferably displaceable with respect to each other. The second hinge part of the door hinge may include two opposite side walls disposed perpendicular to a pivot axis between the first and second hinge parts. The first and second flexible arms may extend parallel to the pivot axis for engaging front edge portions of the two opposite side walls.

BRIEF DESCRIPTION OF THE DRAWINGS

Several embodiments of the present invention are elaborated upon below with reference to the accompanying drawings, in which.

DETAILED DESCRIPTION

Figure 1:
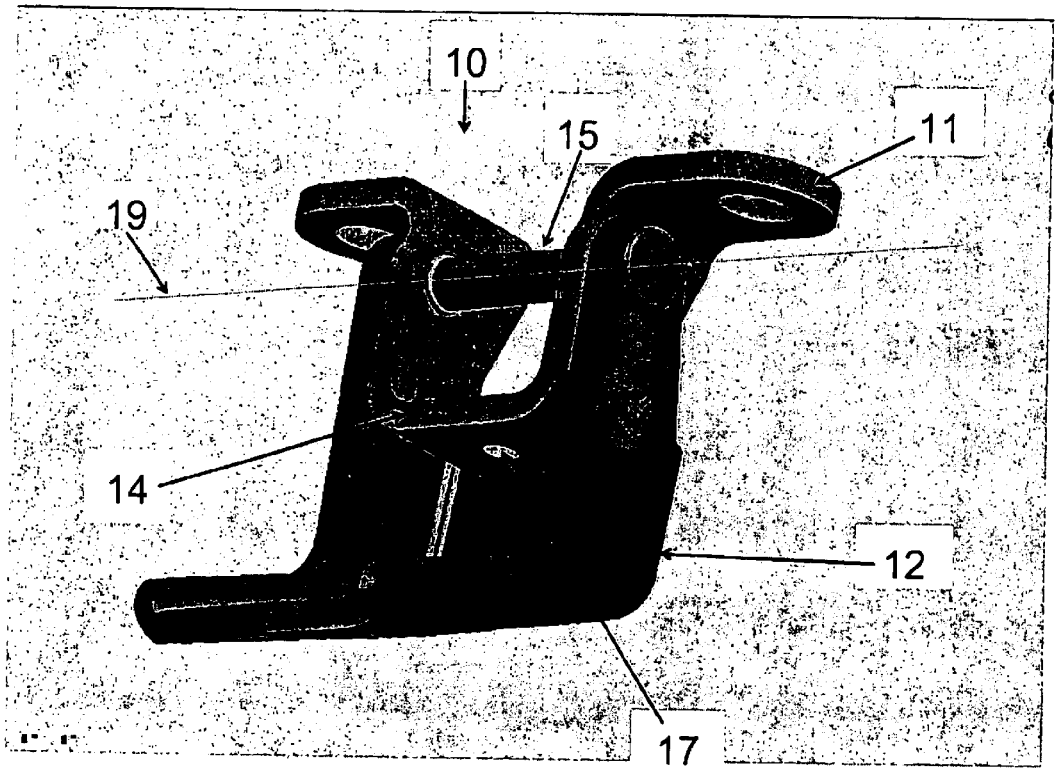
FIG. 1 shows a perspective view of an example of a typical vehicle door hinge, with which a removable door check device according to the present invention may be used.

A typical vehicle door hinge 10 is shown in FIG. 1. Door hinge 10 includes first hinge part 11 and second hinge part 12 pivotally connected to first hinge part 11 about hinge axis 19. Hinge pin 15 passes through hinge axis 19 and connects first and second hinge parts 11, 12 to one another. First hinge part may include hole 17 in a central region, which may be used to engage a contact element of a removable door check device according to the present invention, such as device 30 shown in FIGS. 4 and 5. In some vehicle hinges, instead of a single hinge pin 15 spanning from one side of the hinge 10 to the other, split pins are used, with one pin on each side of the hinge (see, for example, hinge 100 in FIG. 5). In other vehicle hinges, for example hinge 200 shown in FIG. 7, one of the first and second hinge parts may include a sleeve portion surrounding the hinge pin.

Figure 2:
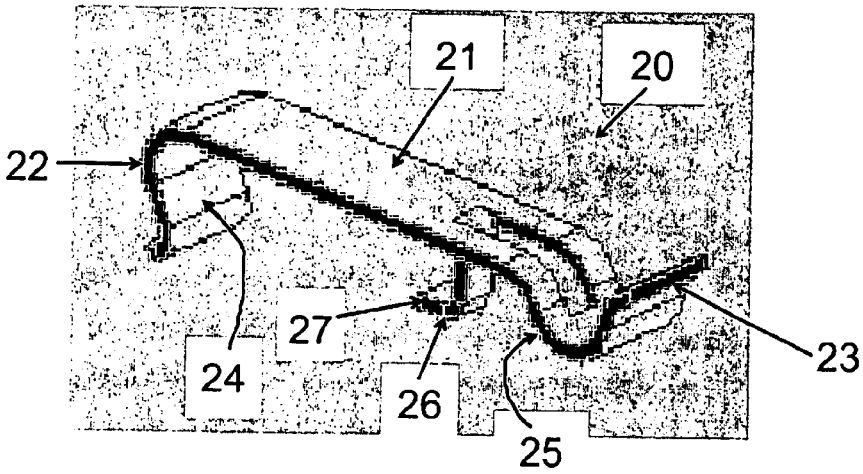
FIG. 2 shows a perspective view of a first embodiment of a removable door check device according to the present invention.
Figure 3:
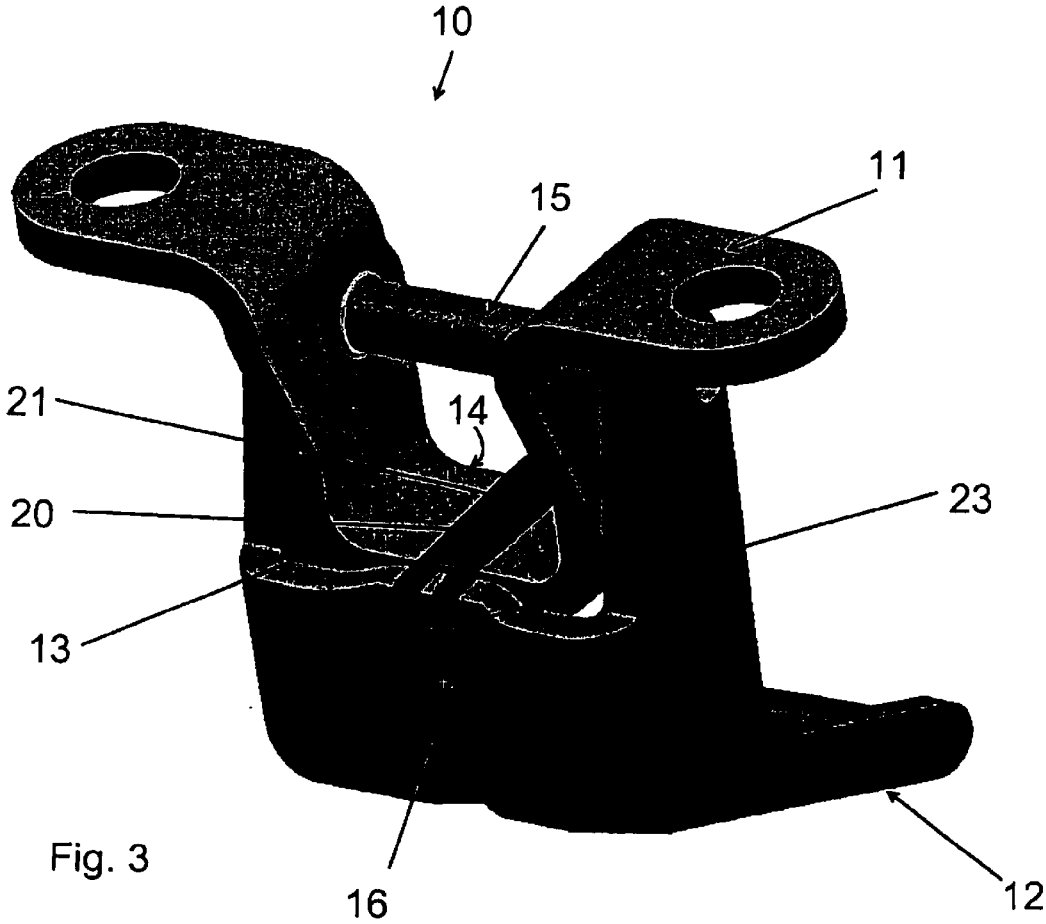
FIG. 3 shows a perspective view of the first embodiment of the removable door check device shown in FIG. 2, together with a vehicle door hinge in an opened position.

A first embodiment of a removable door check device 20 according to the present invention is shown in FIGS. 2 and 3. Removable door check device 20 includes body 21. At one end of body 21 first contact element 22 extends downward and includes first contacting surface 24, which is configured to engage rear edge 14 of first hinge part 11 (shown in FIGS. 1 and 3). Clip element 26 extends downward from an intermediate portion of body 21 and is configured to engage front edge 13 of first hinge part 11 (shown in FIG. 3). Bent end 27 extends around a downward side of hinge part 21 in order to hold door check device 20 firmly to hinge part 11. Second contact element 23 extends from an opposite end of body 21 as first contact element 22. Second contact element 23 extends downward from body 21 and is bent again upward and includes contact surface 25 configured to engage front edge 16 of second hinge part 12.

Removable door check device 20 is preferably integrally formed of a single piece of a flexible material such as a single strip of metal. The first and second contact elements and clip element may be formed by stamping. Alternatively, door check device 20 may be molded using a resilient thermoplastic material.

Door check device 20 is shown attached to hinge 100 in FIG. 3 in an opened position of hinge part 10. In this position, door check device 20 is firmly attached to first hinge part 11. Attachment to first hinge part 11 may be made by moving the vehicle door into a partially opened position to gain access to the hinge. Clip element 26 is hooked over front edge 13 of first hinge part 11 and then first contact element 22 is snapped down over rear edge 14 of hinge part 11. Because of the flexible nature of the material and the shape of door check device 20, the relative positions of first contact member 22 and clip element 26 can be stretched to allow first contact member to fit over the rear edge 14 and then snap down into position so that first contacting surface 24 engages rear edge 14. The removable door check device may also be installed during assembly of the hinge or prior to installation on a vehicle.

When the vehicle door is then moved into the fully opened position, second hinge part 12 comes into contact with second contact element 23 of door check device 20. Again, due to the flexible nature of the material of door check device 20 and the curved shape of second contact element 23, second hinge part 12 contacts second contact element 23 displacing it upward. As second hinge part 12 passes through to its opened position second hinge part 12 moves back down so that second contacting surface 25 engages a front edge 16 of second hinge part 12. Thus, device 20 holds hinge 10 in the open position between first contacting surface 24 of contact element 22 on the one hand, and second contacting surface 25 of second element 23 on the other.

Device 20 holds hinge parts 11 and 12 relative to one another in a releasable manner. An exterior closing force placed on hinge 10 (for example, by pushing he vehicle door in a closing direction) creates a tension between first and second contact elements 22 and 23. Because of the shape of device 20 and the flexible nature of its material, if the closing force is strong enough, second contact element 23 is deflected relative to first contact element 22 sufficiently to release second hinge part 12, and the hinge 10 can again freely move to its closed position.

Door check device 20 can be easily removed again from first hinge part 11 by lifting first contact element 22 over rear edge 14 when the door is in a partially opened position.

Door check device 20 is shaped so that first contacting surface 24 and second contacting surface 25 face each other. As used herein, facing each other does not mean that the surfaces are necessarily directly facing each other or even that they lie in the same plane or are parallel to one another. Rather, it is sufficient that a face of one surface point in a direction that is less than 90 degrees to the direction of a face of the other surface.

Figure 4:
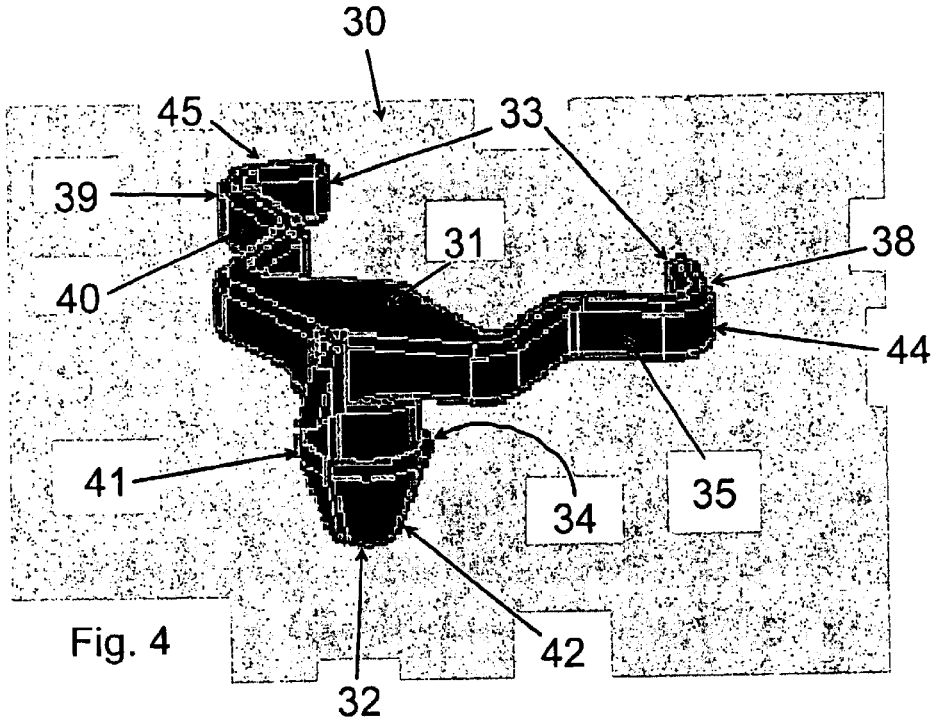
FIG. 4 shows a perspective view of a second embodiment of a removable door check device according to the present invention.
Figure 5:
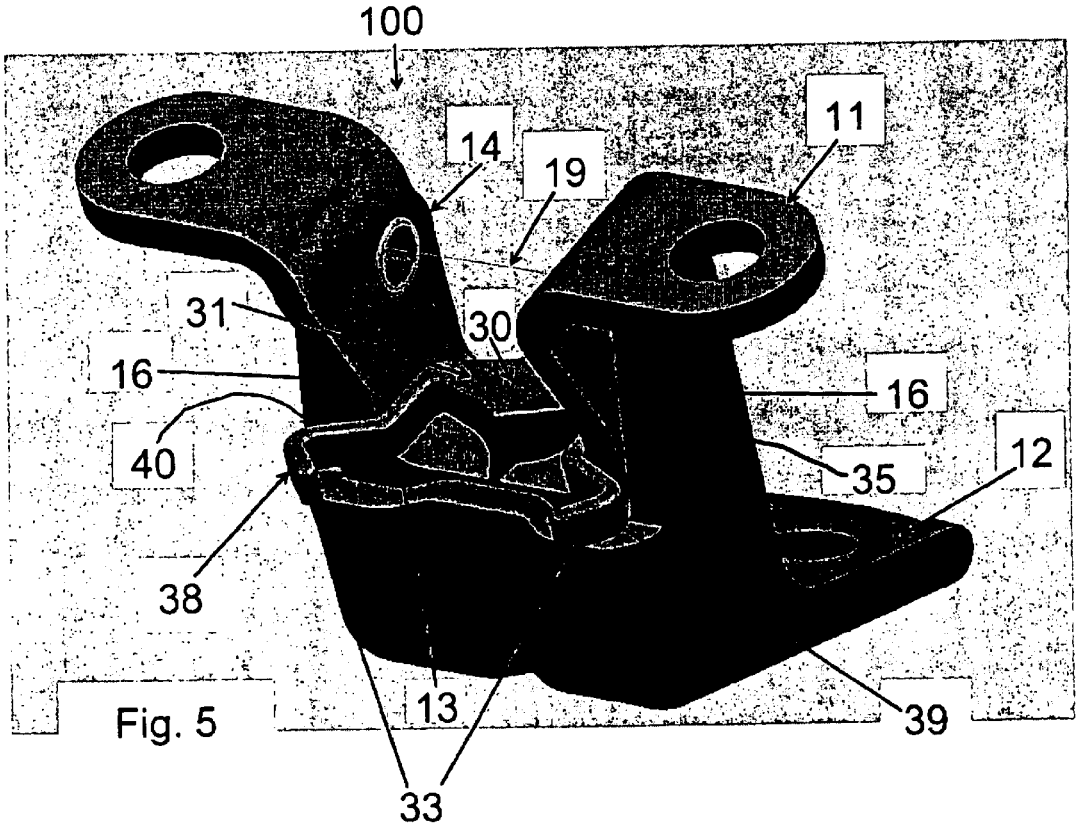
FIG. 5 shows a perspective view of the second embodiment of the removable door check device shown in FIG. 4 together with a vehicle door hinge in an opened position.
Figure 6:
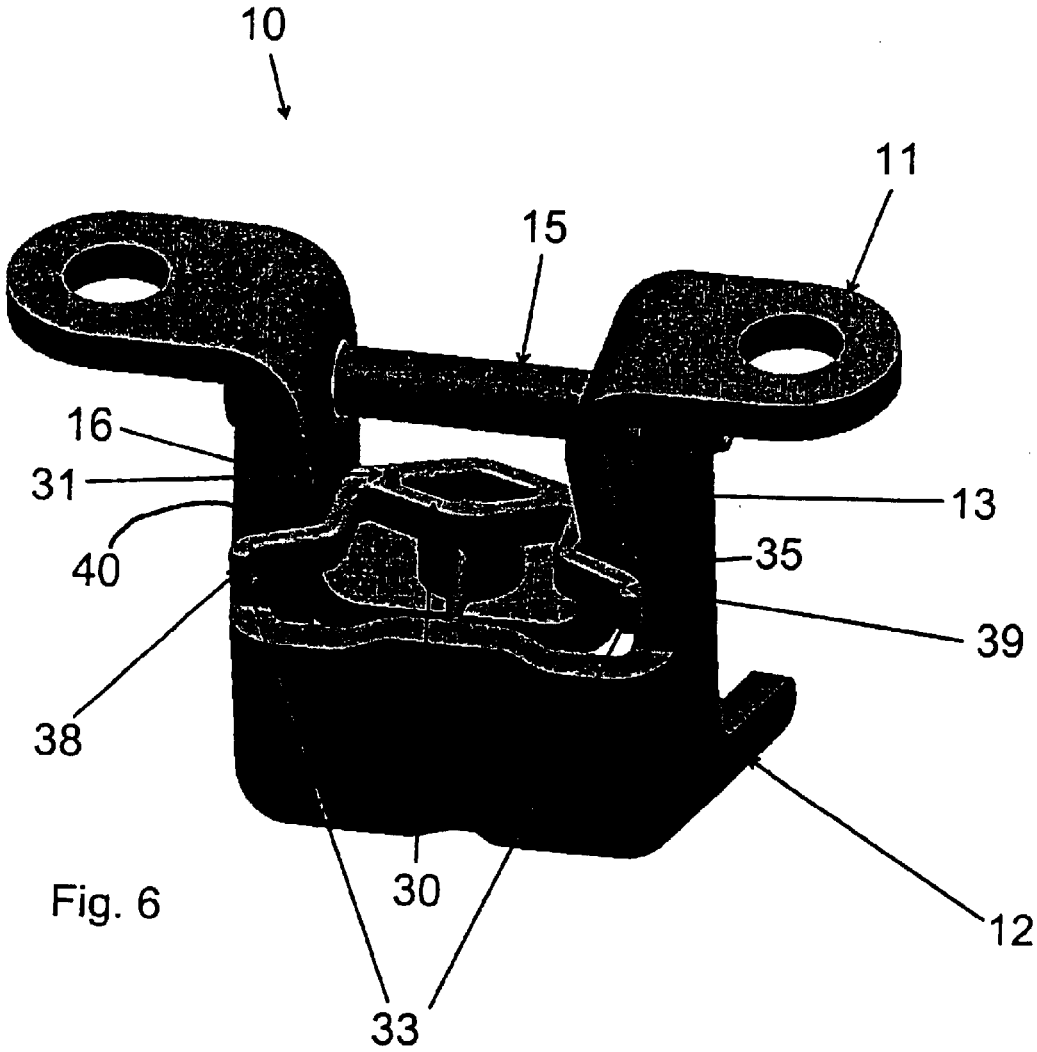
FIG. 6 shows a perspective view of a third embodiment of the removable door check device together with a vehicle door hinge in an opened position.

A second embodiment of a removable door check device 30 is shown in FIGS. 4 and 5. In the second embodiment, door check 30 includes first element 32 extending downward from body 31 in the form of a cylindrical pin, which is configured to engage hole 17 in first hinge part 11. Hole 17 is not visible in FIG. 5 as it is blocked from view from body 31 of door check device 30, but can be seen in the hinge 10 shown in FIG. 1. FIG. 6 shows a third embodiment of a door check device being used with a hinge having a hinge pin 15. The third embodiment differs from the second embodiment only in the shape of the body 31 of the device. Because of the similarities between the embodiments, the corresponding features of both the second embodiment shown in FIG. 5 and the third embodiment shown in FIG. 6 are identified using the same reference numerals.

Door check device 30 is preferably integrally formed of a single piece of material, such as being molded from a resilient thermoplastic material. Cylindrical pin 32 includes an outer flange 41 which is configured to engage a distal end of hole 17, and thereby to keep door check device 30 firmly attached to first hinge part 11. First contacting surface 34, which includes a portion of the outer surface of pin 32 between flange 41 and body 31, engages an inner surface of hole 17 of first hinge part 11. End 42 of pin 32 has a smaller diameter than flange 41 (and than hole 17) and is cone shaped and tapered so that the diameter gradually increases to that of the diameter of flange 41. The smaller diameter of the end 42 and the gradual taper facilitate insertion of the contact element 32 into hole 17.

Door check device 30 also includes a second contact element 33 in the form of first and second flexible arms 38 and 39, which extend from body 31. As the vehicle door is moved to the opened position, the side walls of hinge part 12 force end 44 of first arm 38 and end 45 of second arm 39 toward one another. As the ends 44 and 45 are forced toward each other, second and third contacting surfaces 40, 45 are displaced relative to first contacting surface 34 of first element 23. In the opened position, second contacting surface 35 of first arm 38 and third contacting surface 40 of second arm 39 engage front edge 16 of hinge part 12, thereby releasably holding hinge 100 (and thus, the vehicle door) in the opened position.

Second contacting surface 40 and third contacting surface 35 face toward first contacting 34, which engages an interior surface of hole 17 of first hinge part 11. An exterior force in the closing direction of hinge 100 exerts a tension between first contact element 32 and second contact element 33. If the exterior closing force is great enough, ends 44 and 45 of flexible arms 38 and 39 are displaced towards one another by the side walls of second hinge part 12 and the hinge is released from the opened position.

Door check device 30 can be easily removed from first hinge part 11 by pulling body 31 away from hinge part 11 so as to dislodge pin 32 from hole 17. Because of the flexible nature of the material of device 30, flange 41 can be disengaged from the distal end of hole 17 with moderate force.

Figure 7:
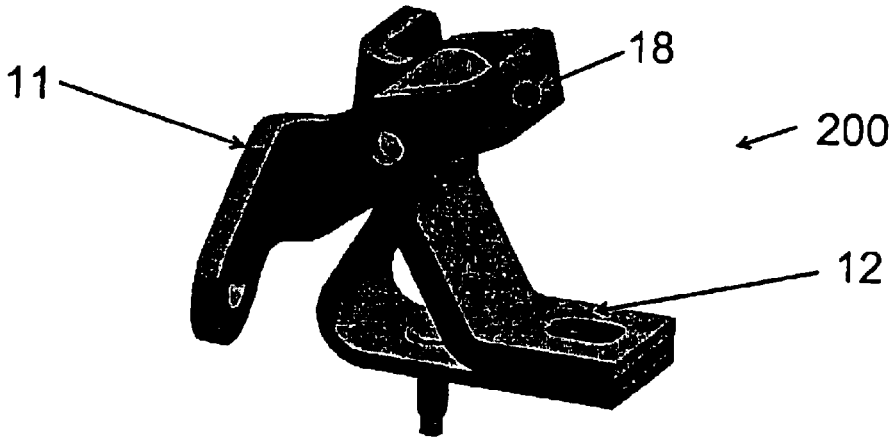
FIG. 7 shows a second example of a vehicle door hinge.
Figure 8:
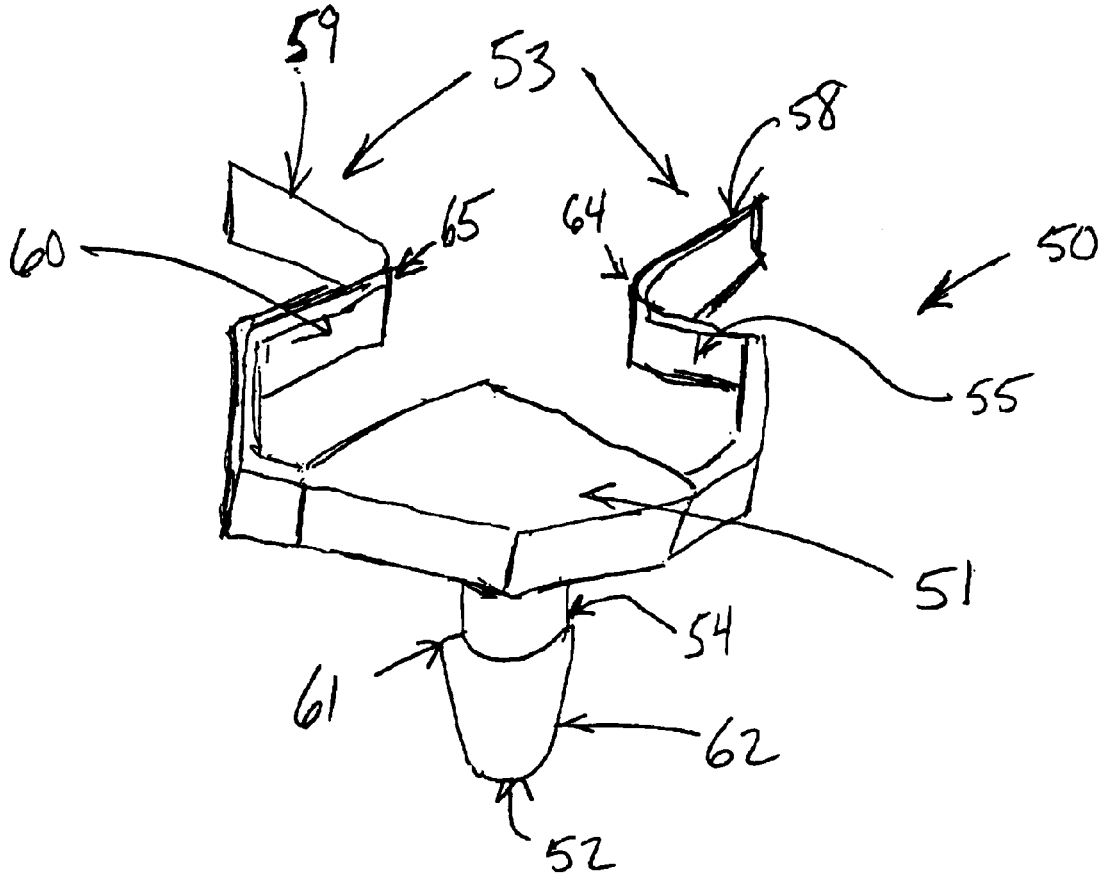
FIG. 8 shows a perspective view of a fourth embodiment of a removable door check device according to the present invention.

FIG. 8 shows a fourth embodiment of a removable door check device 50, to be used together with a door hinge similar to door hinge 200 shown in a closed position in FIG. 7. Door check device 50 includes first element 52 extending downward from body 51 in the form of a cylindrical pin, which is configured to engage hole 18 in first hinge part 11 of hinge 200. Like door check device 30 shown in FIGS. 4 and 5, door check device 50 is preferably integrally formed of a single piece of material, such as being molded from a resilient thermoplastic material. Cylindrical pin 52 includes an outer flange 61 which is configured to engage a distal end of hole 18, and thereby to keep door check device 50 firmly attached to first hinge part 11 of hinge 200. First contacting surface 54, which includes a portion of the outer surface of pin 52 between flange 61 and body 51, engages an inner surface of hole 18 of first hinge part 11. End 61 of pin 52 has a smaller diameter than flange 61 (and than hole 18) and is cone shaped and tapered so that the diameter gradually increases to that of the diameter of flange 61. The smaller diameter of the end 62 and the gradual taper facilitate insertion of the contact element 52 into hole 18. Door check device 50 is placed on first hinge part 11 with arms 58 and 59 pointing in the direction of second hinge part 12.

Door check device 50 also includes a second contact element 53 in the form of first and second flexible arms 58 and 59, which extend from body 51. As the vehicle door is moved to the opened position, first hinge part 11 and door check device 50 move toward the sloping face of second hinge part 12. End 64 of first arm 58 and end 65 of second arm 59 are forced part from one another by the sloping face of second hinge part 12. As the ends 64 and 65 are forced away from each other, second and third contacting surfaces 60, 55 are displaced relative to first contacting surface 54 of first element 52. In the opened position, second contacting surface 55 of first arm 58 and third contacting surface 60 of second arm 59 engage an inside edge portion of the triangular opening of hinge part 12, thereby releasably holding hinge 200 (and thus, the vehicle door) in the opened position.

It will of course be understood that the present invention has been described above only by way of example and that modifications of details can be made within the scope of the invention.

What is claimed is:

1. A removable door check device for use for use with a door hinge for holding a vehicle door in an open position, the device comprising:

a body;

a first contact element extending from the body and having a first contacting surface configured to contact the hinge; and a second contact element extending from the body and having a second contacting surface configured to contact the hinge, the second contacting surface facing the first contacting surface, a tension between the first contact element and the second contact element holding the vehicle door in the open position, the first and second contacting surfaces being moveable with respect to each other to permit removal of the door check device.

2. The removable door check device as recited in claim 1 wherein at least one of the body, the first contact element and the second contact element is flexible to permit the first and second contact surfaces to be moveable.

3. The removable door check device as recited in claim 1 wherein the contacting surfaces are parallel to each other.

4. The removable door check device as recited in claim 1 wherein the first and second contact elements are integrally formed from a single piece of material.

5. The removable door check device as recited in claim 1 wherein at least one of the first and second contacting surfaces includes a convex surface.

6. The removable door check device as recited in claim 1 wherein the first contact element includes a cylindrical pin.

7. The removable door check device as recited in claim 6 wherein the pin includes an outer flange.

8. The removable door check device as recited in claim 7 wherein the pin includes an end portion having a diameter narrower than a diameter of the flange.

9. The removable door check device as recited in claim 8 wherein the second contact element includes a first flexible arm having the second contacting surface and a second flexible arm having a third contacting surface, the second and third surfaces facing the first contacting surface.

10. The removable door check device as recited in claim 9 wherein the first and second flexible arms extend in a plane perpendicular to an axis defined by the pin.

11. The removable door check device as recited in claim 9 wherein the first and second flexible arms each include an end portion, the end portions being flexibly displaceable with respect to each other.

12. The removable door check device as recited in claim 1, wherein the first and second contact elements are configured to releasably hold the vehicle door in the opened position.

13. A door hinge comprising:

a first hinge part;

a second hinge part pivotally connected to the first hinge part; and a removable door check device including a first contact element configured to engage the first hinge part and a second contact element configured to engage the second hinge part when door hinge is in the open position, wherein at least portions of the first and second hinge parts are disposed between the first and second contact elements when the door hinge is in the open position.

14. A door hinge comprising;

a first hinge part;

a second hinge part pivotally connected to the first hinge part; and a removable door check device including a first contact element having a first contacting surface configured to engage the first hinge part and a second contact element having a second contacting surface facing the first contacting surface and configured to engage the second hinge part when the door hinge is in the opened position.

15. The door hinge as recited in claim 14 wherein the second contacting surface is configured to releasably engage the second hinge part.

16. The door hinge as recited in claim 14 wherein an external closing force applied to one of the first and second hinge parts creates a tension between the first and second contact elements.

17. The door hinge as recited in claim 16 wherein the external closing force has a predetermined magnitude at which the tension results in the second contact surface releasing engagement with the second hinge part.

18. The door hinge as recited in claim 14 wherein the first contacting surface is configured to engage a rear edge portion of the first hinge part.

19. The door hinge as recited in claim 18 wherein the door check device includes a clip element configured to engage a front edge portion of the first hinge part.

20. The door hinge as recited in claim 19 wherein the clip element includes a bent end for engaging a distal side of the first hinge part adjacent the front edge portion.

21. The door hinge as recited in claim 18 wherein the second contacting surface is configured to releasably engage a front edge of the second hinge part.

22. The door hinge as recited in claim 14 wherein the first contact element includes a cylindrical pin for engaging a hole in the first hinge part.

23. The door hinge as recited in claim 22 wherein the pin has an outer flange for engaging a distal end of the hole.

24. The door hinge as recited in claim 22 wherein the second contact element includes a first flexible arm having the second contacting surface and a second flexible arm having a third contacting surface, the second and third contacting surfaces facing the first contacting surface.

25. The door hinge as recited in claim 24 wherein the first and second flexible arms extend in a plane perpendicular to an axis defined by the pin.

26. The door hinge as recited in claim 24 wherein the first and second flexible arms each include an end portion, the end portions being flexibly displaceable with respect to each other.

27. The door hinge as recited in claim 24 wherein the second hinge part includes two opposite side walls disposed perpendicular to a pivot axis between the first and second hinge parts and wherein the first and second flexible arms extend parallel to the pivot axis for engaging front edge portions of the two opposite side walls.

28. A door hinge for a motor vehicle having a body and a door, the door hinge comprising:

a first hinge part mounted to the body;

a second hinge part mounted to the door pivotally connected to the first hinge part about a hinge axis;

a removable door check device disposed on the first hinge part and the second hinge part, the removable door check device not surrounding and not intersecting the hinge axis.

29. A method for placing a removable door check device on a vehicle door hinge, the door check device having a first contacting surface and a second contacting surface facing the first contacting surface and the vehicle door hinge including first and second hinge parts pivotally connected to each other, the method comprising:

engaging the first contacting surface of the door check device with the first hinge part; and displacing the second contacting surface with respect to the first contacting surface so that second contacting surface engages the second hinge part.

30. The method as recited in claim 29 wherein the displacing is preformed by the first and second hinge parts when the door hinge is moved into an opened position.

* * * * *